US006857580B2

(12) United States Patent
Walter et al.

(10) Patent No.: US 6,857,580 B2
(45) Date of Patent: Feb. 22, 2005

(54) PLUG-IN TYPE LIQUID ATOMIZER

(75) Inventors: Scott D. Walter, Twin Lakes, WI (US); Thomas A. Helf, New Berlin, WI (US); Edward J. Martens, III, Racine, WI (US); Luke Stonis, Columbus, OH (US); John J. Knittle, Westerville, OH (US); Chris von Dohlen, Columbus, OH (US); Dennis J. Denen, Westerville, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 526 days.

(21) Appl. No.: 10/005,655

(22) Filed: Dec. 3, 2001

(65) Prior Publication Data

US 2003/0102384 A1 Jun. 5, 2003

(51) Int. Cl.[7] ..... B05B 3/04
(52) U.S. Cl. ..... 239/102.2; 239/4; 239/102.1
(58) Field of Search ..... 239/4, 102.1, 102.2, 239/145, 326, 338; D23/355, 366–369, 356–363

(56) References Cited

U.S. PATENT DOCUMENTS

| | | | | |
|---|---|---|---|---|
| 5,170,782 A | * | 12/1992 | Kocinski | 128/200.16 |
| D335,530 S | * | 5/1993 | Schimanski | D23/366 |
| 5,657,926 A | | 8/1997 | Toda | 239/102.2 |
| 5,803,362 A | | 9/1998 | Fraccaroli | 239/102.2 |
| 6,085,740 A | | 7/2000 | Ivri et al. | 128/200 |
| 6,296,196 B1 | | 10/2001 | Denen et al. | 239/4 |
| D464,416 S | * | 10/2002 | von Dohlen et al. | D23/366 |

* cited by examiner

*Primary Examiner*—Michael Mar
*Assistant Examiner*—Thach H Bui

(57) ABSTRACT

A piezoelectrically actuated liquid atomizer device which applies alternating voltages from an ordinary wall outlet to a piezoelectric actuator intermittently and at a high rate sufficient to cause an atomization plate which is vibrated by the actuator to form small droplets from liquid which is supplied to the plate. The intermittent application of voltages to the piezoelectric actuator is carried out according to a duty cycle in which the off times are adjustable. An override of the duty cycle is provided so that the piezoelectric actuator operates continuously for intervals which are manually or automatically controlled.

26 Claims, 3 Drawing Sheets

PLUG-IN TYPE LIQUID ATOMIZER

BACKGROUND OF THE INVENTION

1. Field of the Invention

This invention relates to liquid atomizing devices such as misters and dispersants for fragrances, air fresheners and insecticides.

2. Description of the Related Art

It is known to atomize liquids which contain air fresheners, fragrances and insecticides by suppling the liquid to a plate which is vibrated at high frequency by a piezoelectric actuator. Battery powered atomizer devices for dispensing air fresheners and insecticides are shown for example, in U.S. Pat. No. 5,657,926 and No. 6,085,740 and in U.S. application Ser. No. 09/519,560, filed Mar. 6, 2000. It has also been proposed in U.S. Pat. No. 5,803,362, to power a piezoelectric actuated atomizer with an alternating current supply.

Battery powered atomizers are subject to the amount of energy available in the battery; and they are limited in the magnitude of driving voltage that can be applied to the piezoelectric actuator. While an alternating current driven atomizer is not limited in the amount of available driving energy, the unit proposed in U.S. Pat. No. 5,803,362 does not provide for maximum drive voltage to the piezoelectric actuator element. Moreover, the proposed alternating current atomizer involves rectification and smoothing of the alternating voltages, with further processing of those voltages before they are applied across the piezoelectric element. As a result, the atomizer is complicated and expensive. Further, the known alternating current powered atomizer does not permit adjustment or variation in the operating frequency nor does it provide the ability to be controlled according to a predetermined duty cycle.

SUMMARY OF THE INVENTION

In one aspect, the present invention provides a plug-in liquid atomizer which comprises a housing having a generally flat vertical surface from which a pair of prongs extend for plugging into a wall outlet, and a drive assembly mounted in the housing. The drive assembly comprises a piezoelectric actuator which expands and contracts in response to applied alternating electric fields applied across opposite sides thereof. An atomization plate is coupled to the actuator to be vibrated by its expansion and contraction. This vibration atomizes liquid which is supplied to a surface of the atomization plate. A first electrical interconnection is provided between one of the prongs and one side of said piezoelectric actuator; and a second electrical interconnection is provided between the other prong and an opposite side of the piezoelectric actuator. An electronic switch is arranged in association with at least one of the electrical interconnections to control the application of voltages from the prongs to the piezoelectric actuator. Further, an oscillator is connected to the electronic switch to open and close the switch at a rapid rate. This causes a high voltage to be applied at a high frequency across the piezoelectric element.

In another aspect, this invention involves a novel method of atomizing a liquid. According to this novel method, alternating voltages, which are received from an electrical outlet, are supplied through a pair of electrical interconnections to opposite sides of a piezoelectric actuator to cause a piezoelectric actuator to expand and contract and vibrate a plate, which is coupled thereto, while the plate is supplied with liquid to be atomized. At least one of the electrical interconnections is rapidly switched to rapidly connect and disconnect the piezoelectric actuator to and from that interconnection whereby the alternating voltages which are supplied from the interconnections to the actuator, are applied across the actuator intermittently and at a sufficiently high rate to cause the actuator to vibrate the plate at a frequency which causes atomization of liquid supplied to the plate.

Thus, the present invention achieves atomization in a piezoelectrically actuated atomizer using alternating voltages from an ordinary wall outlet by applying the alternating voltages to the piezoelectric actuator intermittently and at a high rate without need to convert the applied alternating voltages from the wall outlet to a smooth direct current and thereafter reconverting the direct current into high frequency alternating voltages.

In a further aspect the present invention provides novel methods and apparatus for producing piezoelectrically actuated atomization of liquids at different and adjustable rates or duty cycles and for overriding duty cycle operation by producing continuous atomization for predetermined or indefinite lengths of time. According to this further aspect, a voltage which is applied to the piezoelectric actuator is rapidly connected to and disconnected from the actuator at a rate which vibrates an atomization plate so that it will atomize liquid which is supplied to one side of the plate. The rapid switching is turned on and then turned off according to a variable duty cycle. In one aspect, the switching is turned on and off by means of a duty cycle oscillator which is controlled so that it turns the switching off for variable amounts of time and on for fixed amounts of time. In another aspect, the switching is maintained continuously for predetermined lengths of time; and the lengths of time may be set by an override oscillator which is connected to prevent the duty cycle oscillator from controlling the switching sequence for a predetermined duration.

In a still further aspect, a manual override switch is provided to override the duty cycle oscillator so that it cannot affect the switching on and of the voltage to the piezoelectric actuator for as long as the manual override switch is held in its actuated position.

DETAILED DESCRIPTION OF THE PREFERRED EMBODIMENTS

Figure 1:
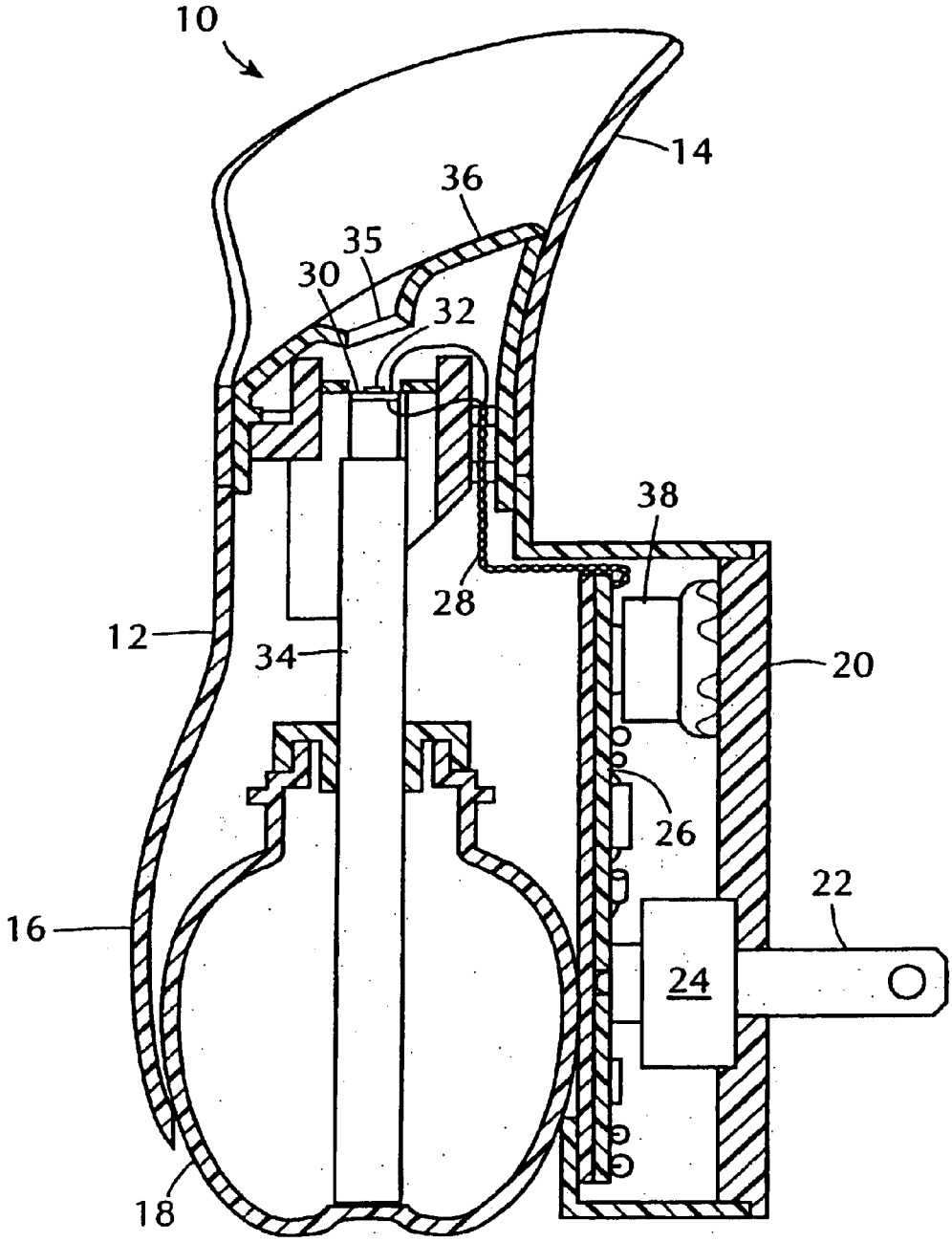
FIG. 1 is a side elevation view, taken in section, of an atomizing device according to the present invention.

An atomizing device 10, according to one embodiment of the present invention, comprises a hollow plastic housing 12 formed with an outwardly flaring top region 14 for expelling atomized liquid droplets, a bulbous open lower region 16 for removably receiving a removable reservoir 18 which contains a liquid to be atomized, and an expansive opening at one side which supports a flat vertical wall 20.

The wall 20 supports a pair of electrical prongs 22 (only one of which can be seen in FIG. 1) for plugging into an ordinary electrical wall outlet. The prongs 22 are supported in a solid mounting piece 24 which is fixed into the wall 20, so that when the atomizing device 10 is plugged into an electrical wall outlet, it is firmly supported by the outlet and requires no other support. The prongs 22 shown in FIG. 1 are configured for conventional North American electrical outlets. For use of the device in other countries, the prongs would be configured and positioned to fit in outlets used in those other countries.

A printed circuit board 26 is supported in a position displaced from and parallel to the wall 20 inside the housing 12. The prongs 22 are connected to circuits on the printed circuit board 26, as will be explained hereinafter. A pair of wires 28 extend from the printed circuit board 26 to the opposite sides of a piezoelectric actuator 30.

The piezoelectric actuator 30, when energized by alternating electric fields applied across the opposite surfaces thereof, causes an orifice plate 32 which is affixed to the actuator 30 and extends across a center opening thereof, to vibrate rapidly up and down. This in turn causes liquid from the reservoir 18, which is delivered to the underside of the plate 32 by means of a capillary device 34 extending up from within the reservoir, to be atomized and expelled upwardly from the plate. The atomized liquid in the form of very fine droplets pass through an opening 35 in a top wall 36 within the flaring top region 14 and out into the atmosphere.

The actuator 30 and the orifice plate 32 may be mounted so that they are tilted from the horizontal so as to direct the atomized liquid away from a surface on which the atomizing device 10 is mounted, for example a wall in a room. This serves to protect the wall from the aggressive nature of the liquid being atomized, such as a fragrance.

When the liquid in the reservoir 18 is atomized and the reservoir is empty, it can be pulled out from the housing 12 and replaced by a full reservoir. As can be seen, the reservoir 18 is held in place within the housing 12 by virtue of the shape and bendability of the bulbous lower region 16 of the housing.

As will be explained in more detail below, the piezoelectric actuator 30 may be energized in a manner to cause the atomization to occur in individual puffs which are separated in time by adjustable amounts. Alternatively, the actuator can be energized in a continuous manner for predetermined durations to produce continuous atomization. An adjustment wheel 38 is provided inside the housing with its periphery extending outside the housing so that it can be turned. The adjustment wheel is connected to a variable resistance device on the printed circuit board 26 for adjustment of the duration between successive puffs of atomized liquid.

To operate the actuator 30, the reservoir 18, which is filled with a liquid to be atomized, is inserted into the bottom of the housing 12 as shown in FIG. 1 so that the upper end of the capillary device 34 is just below the orifice plate 32. Thus, liquid from the reservoir is brought to the bottom surface of the orifice plate by capillary action. The device 10 is then plugged into an ordinary electrical wall outlet by inserting the prongs 22 into the wall outlet openings. The prongs 22 engage the outlet openings snugly and provide sufficient support to hold the atomizing device on the wall. Alternating voltages are supplied from the wall outlet via the prongs 22 to the circuits on the printed circuit board 26. As will be explained in conjunction with FIGS. 2 and 3, the circuits on the printed circuit board switch the alternating voltages on and off very rapidly, e.g. at 140 to 170 kilohertz, and apply the switched voltages via the wires 28 across the piezoelectric actuator 30. This causes the actuator to expand and contract according to the applied voltages. The actuator 30 in turn vibrates the orifice plate 32 so that it atomizes the liquid being supplied to its lower surface from the reservoir 18. The orifice plate expels this liquid in the form of very small droplets out through the opening 35 in the top plate 36 and into the atmosphere.

Figure 2:
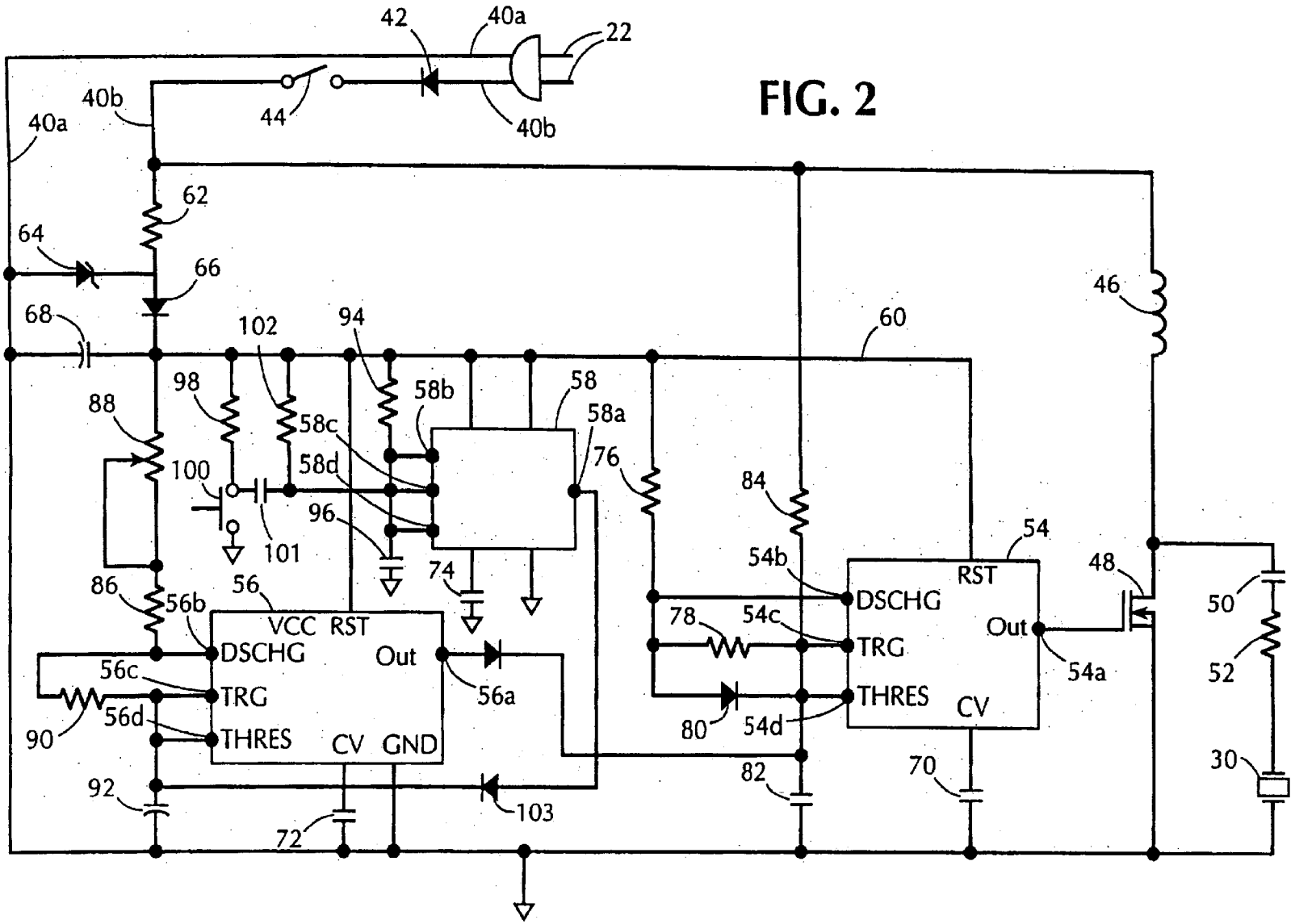
FIG. 2 is a circuit diagram of a printed circuit for a printed circuit board contained in the device of FIG. 1.

FIG. 2 is a schematic showing the circuits on the printed circuit board 26. As can be seen, the prongs 22 are connected respectively to input wires 40*a* and 40*b*. The wire 40*a*, as shown, is connected directly to ground; while the wire 40*b* has interposed therealong a rectifier diode 42 and a switch 44. The diode 42 may be any standard general purpose rectifier diode. Preferably, the diode 42 should be capable of 400 volt reverse blocking and of handling 0.25 ampere peak current and 0.01 ampere average current. A 1N4004 rectifier diode has been found suitable for this purpose, although other diodes may be used.

The switch 44 is a simple on-off switch which turns the atomizing device 10 on and off. Preferably the switch 44 is integrated with a duty cycle switch, to be described, and controlled by the adjustment wheel 38.

The input wire 40*b* beyond the switch 44 is connected to a flyback coil 46. From there the wire 40*b* is connected to a parallel circuit which includes an electronic switch 48 in one branch and a capacitor 50, a resistor 52 and the piezoelectric actuator 30 in series with each other, in the other branch. The two branches are thereafter each connected to ground.

A fuse, not shown, may be provided in series with one of the lines 40*a* and 40*b* to protect the system against the occurrence of unexpectedly high line voltages.

In operation, the circuit of FIG. 2 as thus far described, operates to apply voltages, which are supplied via the prongs 22, across the piezoelectric actuator. While the voltages across the prongs 22 vary between zero and 160 volts, they are increased to as much as 300 volts, peak to peak, as they are applied across the piezoelectric actuator 30. This is due to the inductance of the flyback coil 46 and the rapid switching of the electronic switch 48. The voltage derived from the prongs is applied to the piezoelectric actuator 30 in the form of short pulses which occur at a high rate, e.g. 130,000 to 160,000 pulses per second. These voltage pulses are produced by opening and closing the electronic switch 48, i.e. by making it conductive and non-conductive. When the electronic switch 48 is closed or in its conductive state, the coil 46 is effectively connected to ground so that current flows from the prongs 22 through the coil 46 to ground. During this time, the coil 46 stores energy from this current flow according to the formula $\frac{1}{2} LI^2$ (L being the inductance of the flyback coil 46, in henries, and I being the current supplied from the prongs 22 in amperes). Then when the switch 48 is opened, i.e. in its non-conductive state, the energy stored in the flyback coil 46 is applied through the capacitor 50 and the resistor 52 and across the piezoelectric actuator 32 at an energy level of $\frac{1}{2} CV^2$, C being the capacitance of the capacitor 50 in farads and V being the voltage from ground to the connection of the flyback coil 46 to the parallel circuit). Thus, different voltages are applied across the piezoelectric actuator 30 at the rate according to that at which the electronic switch 48 is switched between its conductive and non-conductive states.

In the illustrative embodiment of FIG. 2, the flyback coil 46 may have an inductance of about 10 millihenries and the capacitor 52 may have a capacitance of about 0.01 _farads for example. This, together with the capacitance of the piezoelectric actuator 30 and the inductance of the flyback coil 46 provides a resonant circuit frequency of about 39 kilohertz. This provides adequate time for energy storage in the flyback coil between successive switchings of the electronic switch 48 when it is switched at a rate at which the piezoelectric actuator 30 is to be vibrated, e.g. 140 to 170 kilohertz. The resistance of the resistor 52 together with the internal resistance of the flyback coil 46 reduces the Q of the resonant circuit so that it will resonate over the range of frequencies at which the electronic switch 48 is operated, e.g. 140 to 170 kilohertz. These values are illustrative and not critical and one skilled in the art would readily be able to use this invention with other component values.

The flyback coil 46 may be of simple design and may be formed of many turns of fine wire in a simple winding arrangement over a core of low magnetic permeability material or it may be wound over an air core.

The electronic switch 48 may be any electronically operated switch that is rendered alternatively conductive and non-conductive by application of signals to a control input thereof. Preferably the switch 48 is a field effect transistor which is operated by voltages applied to its gate terminal. A preferred form of switch is a DMOSFET, for example a Supertex TN2540N3 switch available from Supertex, Inc., 1235 Bordeau Drive, Sunnyvale, Calif. 94089.

It will be appreciated that if voltage amplification is not needed, the flyback coil 46 and the capacitor 50 and the resistor 52 may be eliminated. In its broader aspects this invention contemplates the application of the alternating voltages received at the prongs 22, to the piezoelectric actuator 30 without first converting these alternating voltages to a continuous and smooth direct current voltage.

The remaining portion of the circuit shown in FIG. 2 is a switch control portion which serves to provide switching voltages to the gate terminal of the electronic switch 48 to cause it to switch between its conductive and non-conductive states according to predetermined frequencies and duty cycles. The switch control portion of the circuit of FIG. 2 operates at lower voltages, e.g. 10 volts; and it comprises, principally, a switch actuator oscillator 54, a duty cycle oscillator 56 and a duty cycle override control 58. These elements and the circuit elements that control them receive a steady direct current voltage, e.g. about 10 volts, from a circuit control voltage supply line 60. The supply line 60 in turn is connected to the wires 40*a* and 40*b* via a voltage drop resistor 62, a zener diode 64, a leakage diode 66 and a filter capacitor 68. The voltage drop resistor 62 and the leakage diode 66 are connected in series between the wire 40*b* and the control circuit voltage supply line 60. The zener diode 64 is connected between the wire 40*a* and a junction between the voltage drop resistor 62 and the leakage diode 66 and the filter capacitor 68 is connected between the wire 40*a* and the control circuit voltage supply line 60. The circuit arrangement of the voltage drop resistor 62, the zener diode 64, the leakage diode 66 and the filter capacitor 68 converts the applied alternating current voltage from the prongs 22 to a steady direct current voltage of about 10 volts to the control circuit voltage supply line 60 for operating the various elements which comprise the switch control portion of the circuit of FIG. 2.

The voltage drop resistor 62 serves to produce a drop in the alternating current input voltage, e.g. from about 220 volts maximum, to about 10 volts for the control circuit voltage supply line 60. This resistor may have a resistance value of 100 K3, although it could be smaller, so long as it allows sufficient current into the filter capacitor 68 so that the capacitor can maintain a uniform voltage on the line 60. The filter capacitor 68 may be quite small, e.g. 10 Farads or less. Its purpose is to reduce the voltage ripple from the input lines which is applied to the control current voltage supply line 60. The leakage diode 66, which may be a small rectifier or general purpose diode, prevents a reverse current from flowing through the voltage drop resistor 62. The leakage diode 66 also makes possible a smaller size of the filter capacitor 68. The zener diode 64 sets the voltage level imposed on the control circuit voltage supply line 60. This may be, e.g. 10 volts, although it could be anywhere from 5 to 15 volts.

The voltage on the control circuit voltage supply line 60 powers the switch actuator oscillator 54 and the duty cycle oscillator 56 as well as the duty cycle override control 58. As shown in FIG. 2, the line 60 is connected to each of these components. Also as shown, each of these components is connected via a noise reduction capacitor, 70, 72 and 74, respectively to ground.

The switch actuator oscillator 54 is a voltage controlled oscillator which is connected to produce a voltage output at an output terminal 54*a* which varies at a rapid rate, e.g. about 170 KHz. The output terminal 54*a* is connected to the gate terminal of the electronic switch 48 so that the switch is opened and closed, i.e. made conductive and non-conductive, at a rate corresponding to the frequency output of the oscillator 54.

The operating frequency of the switch actuator oscillator 54 is controlled by voltage inputs to a discharge terminal 54*b*, a trigger terminal 54*c* and a threshold terminal 54*d*. The discharge terminal 54*b* is connected via an on-time resistor 76 to the control circuit voltage supply line 60. The trigger terminal 54*c* is connected via an off-time resistor 78 and the on-time resistor 76, which are in series with each other, to the control circuit voltage supply line 60. The threshold terminal 54*d* is connected via a diode 80 and the on-time resistor 76, which are also connected in series with each other, to the control circuit voltage supply line 60. In addition, the terminals 54*c* and 54*d* are connected via an oscillator capacitor 82 to ground. The values of the resistors 76 and 78 and the capacitor 82 establish the normal operating frequency of the switch actuator oscillator 54. Representative values for these elements may be, for example, 10 K3 for the on-time resistor 76, 56 K3 for the off-time resistor 78 and 100 picofarads for the oscillator capacitor 82.

The trigger and threshold terminals 54*c* and 54*d* of the switch actuator oscillator 54 are also connected via a frequency pull resistor 84 to the input wire 40*b*. This connection causes the frequency of the oscillator sweep according to the variation in voltage of the alternating current input to the atomizing device. For example, the oscillator frequency may be swept between 170 and 140 kilohertz at a rate corresponding to the frequency of the alternating input to the device.

The duty cycle oscillator 56 turns the switch actuator oscillator on and off according to a predetermined duty cycle. For example, the duty cycle oscillator 56 may turn the switch actuator oscillator 54 on for periods of 50 milliseconds and off for periods of 10 to 40 seconds, depending on the setting of inputs to the duty cycle oscillator. An output terminal 56*a* of the duty cycle oscillator 56 is connected via a duty cycle diode 86 to the trigger and threshold input terminals 54*c* and 54*d* of the switch actuator oscillator 54. The switch actuator oscillator 54 will continue to oscillate as long as it does not receive a positive voltage input from the duty cycle oscillator 56. However, when a positive voltage from the duty cycle oscillator 56 appears at the trigger and threshold input terminals 54*c* and 54*d* of the switch actuator oscillator 54, its oscillation is interrupted.

The duty cycle oscillator operates at on and off times according to inputs which it receives at a discharge input terminal 56*b*, a trigger input terminal 56*c* and a threshold terminal 56*d*. The discharge input terminal 56*b* is connected via a minimum duty cycle resistor 86 and a variable duty cycle resistor 88, (which are connected in series with each other), to the control circuit voltage supply line 60. The trigger input terminal 56*c* of the duty cycle oscillator 56 is connected via an on resistor 90, the minimum duty cycle resistor 86 and the variable duty cycle resistor 88, all in series with each other, to the control circuit voltage supply line 60. The trigger input terminal 56*c* is also connected together with the threshold terminal 56*d* via a duty cycle capacitor 92 to ground. By adjusting the value of the variable duty cycle resistor 88, the duration at which a positive voltage appears at the output terminal 56*a*, and accordingly the off time of the switch actuator oscillator 54, can be controlled. The duty cycle resistor is mounted so that it can be adjusted by turning the adjustment wheel 38 (FIG. 1).

In general it has been found that duty cycle off times of from 10 to 40 seconds are sufficient to provide good atomization for most circumstances. For this purpose the value of the minimum duty cycle resistor 86 may be 2.2 K3, the value of the minimum duty cycle resistor may be 470 K3 and the value of the variable duty cycle resistor 88 may be adjustable between 1 M3 and zero. Also the value of the duty cycle capacitor 92 may be about 100 picofarads.

The switch actuator oscillator 54 and the duty cycle oscillator 56 may both be formed on a single integrated circuit chip, such as a standard LM556C chip.

From time to time it may be desired to operate the atomizing device continuously, that is with a duty cycle of 100%, for a particular duration. This operation may be achieved by disabling the duty cycle oscillator 56, for example by means of the duty cycle override control circuit 58. The duty cycle override control circuit 58, which may be formed from a standard LM 556 chip, is connected as a one shot circuit. When the circuit 58 is triggered, it produces a positive voltage at an output terminal 58*a* for a predetermined duration, after which the voltage at the terminal 58*a* returns to ground. The positive voltage from the terminal 58*a* is applied via a diode 103 to the threshold and trigger input terminals 56*c* and 56*d* of the duty cycle oscillator 56. This prevents the oscillator 56 from oscillating while its output terminal 56*a* is held at ground potential. As a result, the switch actuator oscillator 54 is allowed to operate continuously, that is at a duty cycle of 100%. At the end of the predetermined duration, the positive voltage from the output terminal 58*a* of the duty cycle override control circuit 58 is removed from the input terminals 56*c* and 56*d* of the duty cycle oscillator 56. When this positive voltage is removed from the terminals 56*c* and 56*d* the duty cycle oscillator 56 begins to operate again to control the operation of the switch actuating oscillator 54 according to the preset duty cycle.

The duty cycle override control circuit 58 has discharge and threshold input terminals 58*b* and 58*d*, which are connected to a junction between a duty cycle override resistor 94 and a duty cycle override capacitor 96. This resistor and capacitor are connected in series with each other between the control voltage supply line 60 and ground. A trigger input terminal is connected to receive a negative going input when an override switch 100 is closed. This override switch is connected between ground and an override resistor 98 which in turn is connected to the control voltage supply line 60. When the switch 100 is closed, the voltage on its upper terminal drops. The voltage drop passes through a capacitor 101 which is connected to the trigger input terminal 58*c*. The terminal 58*c* is also connected via a resistor 102 to the control voltage supply line 60 which maintains the voltage at the terminal 58*c* normally at the voltage of the line 60. When the switch 100 is closed, the voltage at the terminal 58*c* drops to begin a timing period in the override control circuit 58. The capacitor 100 provides isolation so that if the switch 100's held closed, the timing of the circuit 58 will not be affected. When the switch 100 is closed, the terminal 58*c* of the override control circuit receives a negative going voltage which triggers the circuit to 58 produce a positive voltage output at the output terminal 58*a* for a predetermined duration following closing of the switch. This positive voltage causes the duty cycle oscillator 56 to stop oscillating, with its output terminal held at ground potential. The duty cycle oscillator 56 remains in its non-oscillating state for the predetermined duration during which the switch actuator oscillator 54 operates continuously. At the end of the predetermined duration, the positive voltage output from the duty cycle override control circuit 58 is removed from the duty cycle oscillator 56, whereupon it resumes its oscillation and control of the switch actuator oscillator 54 according to the duty cycle set by the variable duty cycle resistor 88.

Figure 3:
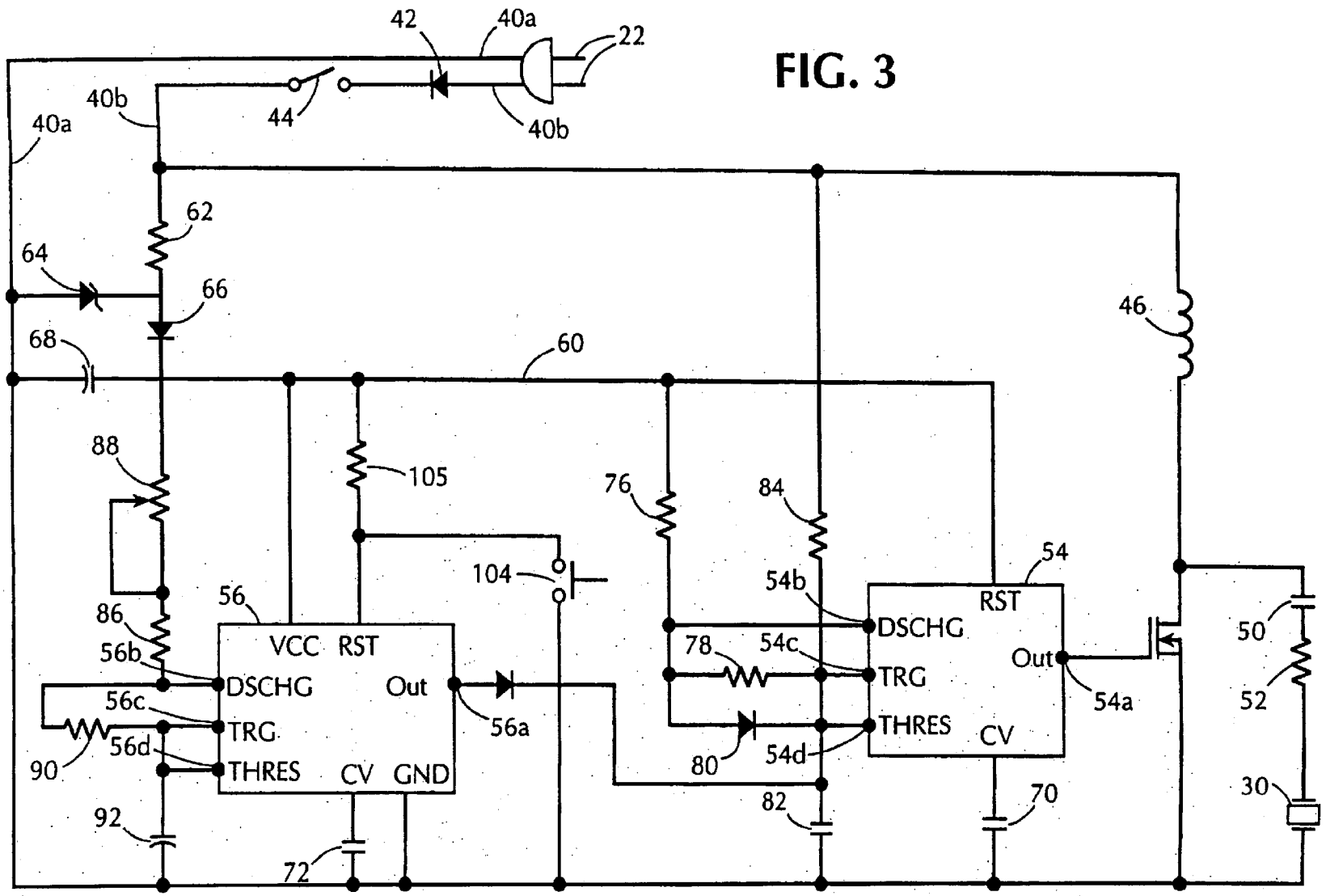
FIG. 3 is a circuit diagram of an alternate printed circuit for a printed circuit board contained in the device of FIG. 1.

In some instances it may be desired to override the duty cycle oscillator 56, not for a predetermined duration, but for as long a manual switch is held closed. For this purpose, instead of the duty cycle override control circuit 58 of FIG. 2, there may be provided a manual control switch 104 and a resistor 105 connected in series between the control voltage supply line 60 and ground, as shown in FIG. 3. Except for the addition of this switch, and the elimination of the duty cycle override control 58 and its associated input and output circuits, the arrangement and operation of the circuit of FIG. 3 is the same as that of the circuit of FIG. 2, and the same reference numerals are used in FIG. 3 as in FIG. 2 for circuit elements which are the same in each circuit. In the case of the system of FIG. 3 when the switch 104 is closed, the reset terminal of the duty cycle oscillator 56 is held at the voltage on the control voltage supply line 60 for as long as the switch 104 is held closed. During this time the duty cycle control oscillator 56 is prevented from operating and the switch actuator oscillator 54 will operate continuously. When the switch 104 is released, the duty cycle control oscillator again begins to oscillate and to resume duty cycle operation.

When the atomizer device 10 is plugged into an ordinary electrical wall outlet, the alternating input voltage from the outlet is applied to the piezoelectric actuator 30. This voltage is applied via the prongs 22, the rectifier diode 42 and the flyback coil 46. The applied voltage will also have been subjected to half wave rectification by the rectifier diode 42. The applied voltage varies from zero to a maximum of 160 volts and back to zero at the frequency of the applied alternating voltage, i.e. in 8 millisecond periods which are interposed with 8 millisecond periods of no voltage, due to the half wave rectification effect of the diode 42. While these varying voltages cause the piezoelectric actuator 30 to expand and contract, and vibrate the orifice plate 32, the frequency of the voltage changes, (e.g. 60 hertz) is insufficient for the orifice plate 32 to atomize the liquid being supplied to it. As a result the device remains in its non-operating state.

It should be understood that the atomizer device 10 may be used in connection with non-U.S. electrical supplies which may use higher voltages, e.g. 220 V. and/or other frequencies, e.g. 50 hertz. In these cases, the device will also remain in its non-operating state.

This non-operating condition remains as long as the duty cycle oscillator 56 keeps the switch actuator oscillator 54 from oscillating, i.e. during the duty cycle off time which, in the embodiments illustrated, may be from 10 to 40 seconds. At the end of this duty cycle off time, the duty cycle oscillator 56 allows the switch actuator oscillator 54 to operate for an on time period of 50 milliseconds. During this 50 millisecond on time, the 60 hertz alternating voltage received at the prongs 22 undergoes three cycles; and consequently the voltage input to the piezoelectric actuator 30 goes from zero to positive and back to zero three times, once during each of the three positive half cycles of the applied voltage. During each of these three positive half cycles, the switch actuator oscillator 54 causes the electronic switch to open and close at a rate which varies between 140 and 170 kilohertz. This causes the flyback coil 48 to apply voltages to the piezoelectric actuator 30 at a rate which varies between 140 and 170 kilohertz and at an amplitude which varies between zero and 300 volts during each of the three positive half cycles, i.e. those which occur during the 50 millisecond on time in which he switch actuation oscillator 54 is oscillating. As a result, the piezoelectric actuator 30 vibrates at frequencies between 140 and 170 kilohertz and at amplitudes corresponding to the instantaneous value of the applied voltage, namely zero to 300 volts. These vibrations are communicated to the orifice plate 32 and cause it to vibrate up and down at corresponding frequencies and amplitudes. These frequencies and amplitudes are sufficient for the orifice plate 32 to produce good atomization of the liquid supplied from the reservoir 18. It can be seen that atomization is produced in the form of puffs with three puffs being produced for each 50 millisecond period during which the switch actuator oscillator 54 is allowed to oscillate while under control of the duty cycle oscillator 56. On the other hand, where the switch actuator oscillator is allowed to operate continuously, for example in the case where the duty cycle override control 58 (FIG. 2) is operated or the manual override switch 102 is closed, the orifice plate 32 will be operated to produce a continuous series of puffs for durations of 8 milliseconds with successive puffs being separated by intervals of 8 milliseconds.

INDUSTRIAL APPLICABILITY

This invention provides an atomizing device and a method of liquid atomization which does not utilize heat or fans to volatilize the active ingredient in liquid formulations. As a result, the active ingredient is delivered linearly and without change in composition until all the liquid in the reservoir has been dispensed. The device can be plugged into an ordinary household outlet and used indefinitely without need for battery recharging or replacement. Further, the device can dispense liquid in the form of very small particles which, because of their large surface area to mass ratio, will readily evaporate and will not fall back to surrounding surfaces as liquid.

In addition, it will be seen that with this invention the rate at which liquid is dispensed can be adjusted on a variable duty cycle basis. Also, the device may be operated continuously for predetermined lengths of time by pressing on and releasing a button which closes and opens the manually operable override switch 98 shown in FIG. 2. Alternatively, the device may be operated continuously for any duration in which a manual control switch 102 is closed.

What is claimed is:

1. A plug-in liquid atomizer comprising:

a housing having a generally flat vertical surface;

a pair of prongs extending out from said vertical surface for plugging into a wall outlet;

a drive assembly mounted in said housing, said drive assembly comprising a piezoelectric actuator which expands and contracts in response to applied alternating electrical fields applied across opposite sides thereof and an atomizing plate coupled to and vibrated by the expansion and contraction of said actuator;

a first electrical interconnection between one of said prongs and one side of said piezoelectric actuator and a second electrical interconnection between the other of said prongs and an opposite side of said piezoelectric actuator, said first and second electrical interconnections being configured to apply alternating voltages from said prongs across said piezoelectric actuator at frequencies insufficient to produce atomization from said plate;

an electronic switch arranged in association with at least one of said first and second electrical interconnections to control the application of voltages from said prongs to said piezoelectric actuator; and an oscillator connected to said electronic switch to open and close said switch at a rapid rate sufficient to cause said plate to atomize liquid applied thereto.

2. An atomizer according to claim 1, wherein a coil is interposed along one of said first and second electrical interconnections.

3. An atomizer according to claim 1, wherein a diode is interposed along one of said first and second electrical interconnections.

4. An atomizer according to claim 1, wherein a switch actuator control oscillator is connected to said electronic switch to control its operation.

5. An atomizer according to claim 4, wherein said switch actuator control oscillator is connected to be operated by electrical power from said prongs.

6. An atomizer according to claim 4, wherein said switch actuator control oscillator operates at a variable frequency.

7. An atomizer according to claim 4, wherein a duty cycle control circuit is connected to turn said switch actuator control oscillator off for predetermined lengths of time.

8. An atomizer according to claim 7, wherein said duty cycle control circuit is arranged to turn said switch actuator control oscillator on for a first predetermined length of time and off for an adjustable period of time.

9. An atomizer according to claim 7, wherein said duty cycle control circuit includes a duty cycle control oscillator.

10. An atomizer according to claim 7, wherein an override control circuit is connected to override said duty cycle control circuit and thereby maintain continuous operation of said switch actuator control oscillator for a given duration.

11. An atomizer according to claim 10, wherein said override control circuit is connected to prevent operation of said duty cycle control oscillator for said given duration.

12. An atomizer according to claim 10, wherein said override control circuit comprises a one shot circuit having a set duration corresponding to said given duration, said one shot circuit being connected to disable operation of said duty cycle control oscillator for said given duration.

13. An atomizer according to claim 10, wherein said override control circuit comprises a switch connected to prevent outputs from said duty cycle control oscillator from being applied to said switch actuator control oscillator.

14. A method of atomizing a liquid comprising the steps of:

applying alternating voltages, which are received from an electrical outlet, through a pair of electrical interconnections to opposite sides of a piezoelectric actuator to cause said actuator to expand and contract and vibrate a plate which is coupled thereto, said plate being supplied with liquid to be atomized, said alternating voltages received from said electrical outlet having a frequency insufficient to produce atomization of liquid supplied to said plate; and rapidly switching at least one of said electrical interconnections to rapidly connect and disconnect said piezoelectric actuator to and from said one interconnection whereby the alternating voltages which are supplied from said interconnections to said actuator, are applied across said actuator intermittently and at a sufficiently high rate to cause said actuator to vibrate said plate at a frequency which causes atomization of liquid supplied to the plate.

15. A method according to claim 14, wherein a coil is interposed along said one electrical interconnection and further including the step of connecting said one electrical interconnection to ground each time it is disconnected from said piezoelectric actuator.

16. A method according to claim 14, including the step of subjecting said alternating voltage to half wave rectification along one of said first and second electrical interconnections.

17. A method according to claim 14, including the step of rapidly switching is carried out by operating an electronic switch by means of an output from a switch actuator control oscillator.

18. A method according to claim 17, including the step of operating said switch actuator control oscillator with electrical power received from said electrical outlet.

19. A method according to claim 17, including the step of operating said switch actuator control oscillator at a variable frequency.

20. A method according to claim 17, including the step of turning said switch control oscillator off for predetermined lengths of time.

21. A method according to claim 20, including the step of turning said switch actuator control oscillator on for a first predetermined length of time and off for an adjustable period of time.

22. A method according to claim 17, wherein said actuator control oscillator is turned on and off by means of a duty cycle control oscillator.

23. A method according to claim 22, including the step of overriding said duty cycle control circuit to maintain continuous operation of said switch actuator control oscillator for a given duration.

24. A method according to claim 22, wherein said step of overriding is carried out in a manner to prevent operation of said duty cycle control oscillator for said given duration.

25. An atomizer according to claim 22, wherein said overriding is carried out by means of a one shot circuit having a set duration corresponding to said given duration, said one shot circuit being connected to disable operation of said duty cycle control oscillator for said given duration.

26. An atomizer according to claim 22, wherein said overriding is carried out by means of a switch which is connected to prevent outputs from said duty cycle control oscillator from being applied to said switch actuator control oscillator.

* * * * *